US008631788B2

(12) United States Patent
Landé

(10) Patent No.: US 8,631,788 B2
(45) Date of Patent: Jan. 21, 2014

(54) ARTIFICIAL GILLS FOR DEEP DIVING WITHOUT INCURRING THE BENDS AND FOR SCAVENGING $O_2$ FROM AND DISPELLING $CO_2$ INTO WATER OR THIN AIR

(76) Inventor: Arnold J. Landé, St. Paul, MN (US)

( * ) Notice: Subject to any disclaimer, the term of this patent is extended or adjusted under 35 U.S.C. 154(b) by 1283 days.

(21) Appl. No.: 12/156,481

(22) Filed: Jun. 2, 2008

(65) Prior Publication Data

US 2008/0295828 A1 Dec. 4, 2008

Related U.S. Application Data

(60) Provisional application No. 60/932,716, filed on Jun. 2, 2007.

(51) Int. Cl.
*A62B 7/00* (2006.01)

(52) U.S. Cl.
USPC ..... 128/200.25

(58) Field of Classification Search
USPC ..... 128/200.24–200.25, 200.29, 201.27; 405/185–187; 95/46, 54; 96/6, 8, 10; 210/640, 650–652
See application file for complete search history.

(56) References Cited

U.S. PATENT DOCUMENTS 3,333,583 A * 8/1967 Bodell ..... 128/200.25
4,609,383 A * 9/1986 Bonaventura et al. ..... 95/46
4,896,664 A * 1/1990 Harayama ..... 128/200.25
5,358,689 A * 10/1994 Jones et al. ..... 422/46
6,348,175 B1 * 2/2002 Borovetz et al. ..... 422/45
2004/0003811 A1 1/2004 Bodner
2011/0146491 A1 * 6/2011 Suefuji et al. ..... 96/8

FOREIGN PATENT DOCUMENTS

JP 05-184812 * 7/1993 ..... B01D 19/00

* cited by examiner

*Primary Examiner* — Oren Ginsberg
(74) *Attorney, Agent, or Firm* — Thomas J. Nikolai; Nikolai & Mersereau, P.A.

(57) ABSTRACT

The invention provides a system whereby oxygen can be derived from seawater or from thin air at higher altitudes while simultaneously eliminating carbon dioxide from the blood. This allows prolonged underwater liquid breathing at greater depths without suffering from the bends or, alternatively, the ability of workers to breathe underwater or at high altitudes without having to rely upon air tanks or the like. The artificial gill comprises a plurality of concatenated modules each containing a semi-permeable membrane operative to transfer oxygen in a first direction and carbon dioxide in a second direction across the membrane. By providing multiple concatenated interconnected modules, oxygen becomes concentrated to allow breathing thereof. Because the system is connected in series with a person's blood supply, $CO_2$ produced in the body is extracted and disposed of via the artificial gill. The semipermeable membrane preferably comprises a plurality of tubular fibers, each with a relatively large lumen when compared to present day blood oxygenators arranged as a bundle in a housing such that seawater or rarefied air passes over the exterior surfaces of the fibers while blood or Hgb flows through the lumens. The larger diameter fibers reduce hemolysis and clotting.

2 Claims, 12 Drawing Sheets

ARTIFICIAL GILLS FOR DEEP DIVING WITHOUT INCURRING THE BENDS AND FOR SCAVENGING $O_2$ FROM AND DISPELLING $CO_2$ INTO WATER OR THIN AIR

CROSS-REFERENCE TO RELATED APPLICATION

This application claims priority to Provisional Application Ser. No. 60/932,716, filed Jun. 2, 2007, the contents of which are hereby incorporated by reference.

BACKGROUND OF THE INVENTION

1. Field of the Invention

This invention relates generally to artificial organs, and in particular to a both sides of a semipermeable membrane, low flow-by resistances "artificial gill" or "artificial lung". The preferred embodiment, complementing liquid breathing through efficient $CO_2$ removal, can be utilized for deep diving with normal sea level blood gases and without being threatened by the bends. Incorporated in a preferred embodiment, multi-artificial gills, "synthetic gill", is a plurality of sequenced, diminishing membrane areas, diminishing volumes, increasing concentrations, two gills hemoglobin (Hgb) circuits that can be utilized for scavenging, concentrating, storing and delivering $O_2$ from seawater in the case of a diver or from thin air in the case of a high altitude climber, and for dispelling $CO_2$ from the diver's or climber's breathing cycle into water or air. An artificial gill utilized as an artificial lung, with the blood flowing through the comparatively large lumens of the identical hollow fibers, minimizes chaotic and stagnant blood flow which can engender clotting and embolization.

2. Discussion of the Prior Art

Both deep diving without being threatened by the bends and scavenging $O_2$ from water to "swim like a fish" have fascinated minds for as long as humans have been able to dream. The bends have been circumvented only slightly by saturation diving, which is burdened by the logistics of extremely long decompression. Inert gases alchemy to replace N2 is of only marginal value. Liquid breathing's promise of sea level blood gases throughout a dive came a cropper over the inability of the blood borne $CO_2$ to be adequately disposed of. Liquid breathing has found a clinical niche. Systems for oxygen extracting and concentrating from seawater or thin air continue to require large expenditures of energy and are suited for nuclear submarines, but probably not for free swimming divers. Alon Bodner of Israel engendered widespread publicity recently with his "Like a Fish" seawater centrifuge (U.S. Patent Publication No. 2004/0003811) in which lowered central pressures left by higher peripheral centrifugal pressures permit the central seawater to give up some of its dissolved air, including $O_2$. Again, much energy is involved and this appears more applicable to submersibles rather than to divers. Waseda University in Tokyo has had a long running interest in artificial gills for oxygen scavenging and they seem to have gravitated away from other $O_2$ carriers and toward Hgb as a first receiver of $O_2$ across the membrane. They also manipulate their system with Inositol Hexaphosphate and energy consuming reciprocating temperatures. They have not recognized the utility of sequencing their Hgb in order to achieve stepwise seawater derived oxygen concentration (Matsuda, N, Sakai Technical Evaluation of Oxygen Transfer Rates of Fish Gills and Artificial Gills ASAIO J, 1999 293-298).

1. Deep Diving Artificial Gill

Liquid Breathing

Liquid breathing, on which much effort and large sums of money have been spent, does continue to hold the exciting promise that excessive concentrations of N2 or other inert "diving gases" in the blood might be avoided altogether, by flooding bodily air cavities (except bowel) with non compressible liquids, in order to eliminate altogether the highly compressed gases dissolving in blood, which is the root cause of the bends when ascent and decompression eventually take place. Would that all other breathing gases might just be replaced with $O_2$, that could be rapidly consumed in metabolism. Unfortunately, there are low limits to the concentrations of $O_2$ that tissues can withstand, without being "burned", most notably in newborns whose loss of eyesight has been so proved.

Liquid breathing's great potential for $O_2$ adequacy, despite the inefficiency of tidal breathing to adequately deliver viscous liquids in and out of end alveoli, stems from the capacity to dissolve high concentrations of $O_2$ in the liquid proportional to the increasingly high pressures encountered during descent into the depths. Perfluorocarbon liquids (PFC) exhibit one-fourth the surface tension, sixteen times the oxygen solubility and three times the carbon dioxide solubility of water. Since oxygen and carbon dioxide dissolve so easily in this liquid, it is an excellent medium for carrying oxygen. Only a small proportion of the highly oxygenated breathing liquid needs to make it out into the twigs of the respiratory tree to achieve the required concentration of $O_2$ in the blood. Delicate end alveolar membranes see only relatively normal concentrations of $O_2$ and hence are not threatened by burn. One wishes that $CO_2$ removal might be so easily accomplished.

The advantages of breathing a liquid while deep diving are undeniable. When a diver descends below 120 feet, even helium, substituted for nitrogen in diving, may be related with an effect called High Pressure Nervous Syndrome (HPNS).

Gas toxicity caused by oxygen has been shown to damage the lung and will vary with partial pressure above one atmosphere and time of exposure and is a concern when the molar fraction of oxygen is increased, as in nitrox diving. The effect of carbon dioxide changes from a respiration stimulant at normal partial pressures of 15-40 mmHg to a respiration suppressor above 80 mmHg.

The trick of just increasing $O_2$ concentrations in the breathing liquid to elevate partial pressure gradients cannot be similarly applied to $CO_2$ because the diver cannot tolerate much elevated $CO_2$ levels in blood. Thus, the seeming dead end of liquid breathing research has been the inability to dispose of sufficient $CO_2$ through the liquid filled, even when mechanically assisted, tidally breathed lungs. Partial liquid breathing combined with Extracorporeal Membrane Oxygenation (ECMO) has demonstrated some clinical promise; hence, my interest in exploring the possibility of an artificial gill for $CO_2$ removal during deep diving with liquid breathing. Similar to a fish's gills, a membrane oxygenator-like artificial gill is a flow-through device, rather than a tidal device with. Given sufficient one-way flows of ambient water or a heat preserving closed circuit decarbonated breathing liquid, considerable $CO_2$ removal can be expected. ECMO for $CO_2$ removal during gentle, lung preserving one way insufflation of humidified $O_2$ down the trachea, has demonstrated that only about ⅕ of cardiac output needs to be diverted extracorporeally in order to fully achieve the goal of proportionally dispelling $CO_2$ (Kolobow, T., Gattinini., Tomlinson, T., Pierce,: Control of breathing using an extracorporeal membrane lung. Anesthesiology 46:138, 1977).

A trained athlete diver with cardiac output of 25 lpm would require the diversion of only 5 liters of femoral artery to femoral vein flow, a proportion easily acquired by modern percutaneous cannulation techniques. Oxygenation might also be not insignificantly aided, and silicone rubber membranes are not subject to $O_2$ burn. Thus, interest in complementing the past efforts on liquid breathing with an artificial gill for $CO_2$ removal seems warranted.

Liquid breathing has fascinated a number of researchers and a great deal of money has been spent on attempting to make it a viable, bends free, method for deep diving. (Lundgren C E Ornhagen H C. "Oxygen consumption in liquid breathing mice," Aerosp Med (1972 August) 43(8): 831-5) (Lynch P R Wilson J S Shaffer T H Cohen N. "Decompression incidence in air- and liquid-breathing hamsters." Undersea Biomed Res (1983 March) 10(1):1-10).

Johannes Kylstra at the University of Buffalo, the most prolific researcher of liquid breathing in the 1960's, already recognized that the insufficiency of $CO_2$ removal could not be similarly overcome by just increasing the dissolved gas pressure differential. Kylstra's hamsters survived huge pressure bounces lasting a few seconds and seemingly were not effected (Kylstra J A "Liquid breathing." Undersea Biomed Res 1974 September 1(3):259-69).

Leland C. Clark and Frank Gollen at the University of Cincinnati, later in the 60's, came upon Fluorocarbon liquids as excellent carriers of $O_2$ gas, and these liquids have been the strong hand of clinical liquid breathing ever since. Alliance Pharmaceutical's "Liquivent" stands out (Gollan F Clark L C, "Prevention of bends by breathing an organic liquid," Trans Assoc Am Physicians (1967) 80:102-10) (Gollan F Clark L C. "Rapid decompression of mice breathing fluorocarbon liquid at 500 PSI," Ala J Med Sci (1967 July) 4(3):336-7).

Moskowitz early recognized the need for mechanical means to relieve the effort required to tidally breathe heavy liquids. Clinicians caring for patients with underdeveloped or threatened lungs have made most use of these technologies at normal, ambient pressures (Moskowitz G D. "A mechanical respirator for control of liquid breathing," Fed Proc 1970 September-October 29(5) (Moskowitz G D, Dubin S, Shaffer T H "Technical report: demand regulated control of a liquid breathing system," J Assoc Adv Med Instrum 1971 September-October 5(5):273-8).

The artificial gill as an adjunct to liquid breathing, specifically to remove $CO_2$, does not appear to have been recognized during the early heyday of hopes for liquid breathing in diving. Recently, the impressive works of Gattinoni and Kolobow and others utilizing a membrane oxygenator specifically for $CO_2$ removal during lung preserving minimally breathing one-way $O_2$ insufflation down the windpipe and ECMO appears to point to a resolution of the lingering CO2 problem of liquid breathing deep diving Artificial Gill for Oxygen Scavenging The artificial gill has been dreamed of since time immemorial and since the advent of efficient semipermeable membranes, has been imagined by many as well. Especially since the early days of membrane blood oxygenator development, numerous researchers proposed laying down membrane with seawater on one side and the diver's breathing on the other. Unfortunately, without some means for concentrating the $O_2$, this has not led to any practical result (Ayres, A. W. Gill-type underwater breathing equipment and methods for reoxygenating exhaled breath, U.S. Pat. No. 3,228,394, (1966), Bodell, B. R. An Artificial Gill, Surgical Forum 16 (1965) 173-175), Cussler earlier demonstrated that thin silicone membranes could transfer sufficient gas to support the family dog for a short period of time (Yang, M C, Cussler E L Artificial Gills J. Membr. Sci 42 (1989) 273-284).

Other researchers have taken a very different tack which would include some form of considerable energy expenditure to try to express $O_2$ out of the water: Joseph and Celia Bonaventura of Duke University foamed Hgb with polyurethane and produced a sponge that could attach $O_2$ and later release it on demand, triggered by changes in temperature. They also demonstrated similar attach-and-release capacities for a number of $O_2$ carriers upon the application of electricity. This latter technology is being utilized by their licensee, Aquanautics of Emeryville, Calif., for DARPA work supplying fuel cell powered submersibles.

The sequenced membranes and Hgb circuits arrangement of the present invention is therefore unique in being able to harness universal physiologic principles to carry out both oxygen scavenging and concentration to levels that are useful for a human diver or climber. The present invention also affords a means for dispelling $CO_2$, which fulfills the promise of liquid breathing to permit deep diving without the bends. There is no prior gill work in either of these deep diving or oxygen scavenging areas by anyone, but the use of membrane oxygenators by Gattinoni and Kolobow, principally for dispelling $CO_2$ during gentle, lung preserving clinical $O_2$ insufflation down the trachea, provides an inspiration for this gill work.

Our oxygen scavenging diving technology might be totally integrated with our deep diving technology, where an artificial gill is attached to the A/V bloodstream principally to remove $CO_2$. The artificial gill subsequently discharges that $CO_2$ into the effluent from the liquid respirator and on toward the synthetic gill, where the $CO_2$ laden PFC breathing liquid initiates and sustains the $O_2$ scavenging function of the synthetic gill, which, in turn supplies the liquid breathing respirator with concentrated $O_2$. Another area of interest is the development of nano-engineered membranes, which might make it possible to design the artificial gill much, much smaller (Infoscitex, Waltham, Mass., Personal Communication).

High Pressure Nervous Syndrome (HPNS) poses an additional threat to extreme deep diving, with convulsions threatening at different depths for different individuals. Research on HPNS has been muddied by the presence of concentrated diving gases and it is not clear, what are the effects of the gases verses what are the effects of pressure. The artificial gill for deep diving complementing liquid breathing will provide an excellent experimental platform for further understanding HPNS, without interference from diving gases. Lacking a system for bends free deep diving, considerable progress has been made utilizing submersible robots, but the potential value of a free swimming diver for accomplishing some vital tasks nevertheless remains.

Paracorporeal Artificial Lung

Current oxygenators that are the precursors for artificial gills largely have low resistance-to-flow paths only on one side of the membranes. Since the mid 1980's, most clinical oxygenators have been constructed from fine bore, microporous, hollow fibers with low viscosity $O_2$ or mixed gas flowing through the fiber lumens and blood flowing around the outside wall in a largely counter and cross current direction.

It is believed that this flow arrangement was selected partly for economic reasons based on the easy availability of fibers and the generally short time, high flow and fully anticoagulated conditions of open heart surgery. Hemolysis was also noted while forcing blood through relatively narrow fibers (see below). However, researchers now pursuing the ideal oxygenator for prolonged ECMO or for continuing support with a paracorporeal artificial lung have been perplexed by uneven blood distribution, precipitation and even clotting and embolization at the lower flow rates and lesser anticoagulation that is practiced in a long term patient (Zwischenberger, J. B, personal communication.). The flat plate Landé-Lillehei experimental membrane oxygenator and the clinical Landé-Edwards units of about 1970, 30,000 of which were produced, had low flow resistances on both sides of the membrane but, alas, they have long been out of production. This call, and claims, for a gill-oxygenator with low resistances to flow on both sides of the membranes is thus relevant and can easily be met by the claimed hollow fibers with increased internal diameters, compared with the norm used in heart/lung machines used in cardiac surgery.

Others are working on silicone hollow fiber membranes for oxygenators that with larger lumens would make our gills much more blood friendly. Montoya at MC-3 in Ann Arbor appears to be embarked on such a development, using a "lost wax" method, layering silicone over water soluble mandrills. (U.S. Pat. No. 6,797,212-Method for forming hollow fiber). Also, Yukihiko Nose' at Baylor College of Medicine in Houston, in concert with Fuji Systems in Tokyo, is developing silicone hollow fiber membranes. ("Development of a new silicone membrane oxygenator for ECMO", *Ann Thorac. Cardiovas. Surg.,* 2000 December; 6(6):373-7)

Surgeon's and industry's current preference for generously anticoagulated blood in oxygenators flowing around microporous small diameter hollow fibers, rather than through them, stems in part from the high resistance that accompanied 5 l/min total bypass using the early 1980's Bentley Bos CM50, blood flow through the fibers device, which resulted in hemolysis. By contrast, kidney dialyzers (500 ml/min) have persisted in successfully using the blood flow through the fibers design. Importantly, $CO_2$ removing oxygenators for ECMO as well as paracorporeal artificial lungs are required to process only ⅕ cardiac output (about 1 lpm). Diver's gills might require 1-5 lpm, depending on the level of activity. And long term support of patients as well as working divers and climbers will benefit from the simplified logistics of low resistance, arteriovenous or even pulmonary artery to pulmonary vein flows, whether pump free or pumped minimally. Such prolonged, marginally anticoagulated low flow support will also benefit greatly from the precisely defined flow paths for blood through identical large lumen, low resistance, parallel fibers, as opposed to the chaotic or stagnant paths of blood flowing around the fibers of current devices which results in clot formation and embolism. Unfortunately, both physicians and industry still suffer from the assumptions of short, high flow surgical bypass, while confronting the very different realities of low flow long-term support.

2. Oxygen Scavenging Synthetic Gill

While many researchers have jumped on the idea that all that is needed to breathe underwater would be to provide sufficient permeable membrane, Walter L. Robb, at General Electric, actually created a thin silicone membrane in the 1960's and publicized hamsters living in a box submerged in a fishbowl (U.S. Pat. No. 3,656,276). Cussler earlier demonstrated that thin silicone membranes could transfer sufficient gas to support the family dog for a period of time (Yang, M C, Cussler E L, Artificial Gills J. Membr. Sci 42 (1989) 273-284). However, most have realized that the $O_2$ dissolved in seawater is so sparse that mere diffusion down concentration gradients would never suffice to support a human. The United States Army in 2005 requested proposals for a "synthetic gill", both for diving and for high altitudes, which request made mention of hemoglobin and of swim bladders. It seemed that the Army thought both were of interest for $O_2$ scavenging and storage, but little more guidance was provided. The awardee, INFOSCITEX, along with Case Western Reserve University, proposed to utilize nanotechnology to create a more gill-like membrane with several tiers of nano complexity. Little thought had or has been given to simple mechanisms that might be required to concentrate $O_2$, rather most such thought has been directed toward complex mechanisms that require high levels of energy. (Bonaventure, J and Bonaventura, C., U.S. Pat. No. 4,761,209; Bodner, A., U.S. Pat. No. 7,278,422 licensed by Aquanautics, Emeryville, Calif.).

My interest was peaked by the thought that the unique capacities of Hgb might be harnessed to not only gather, transport, store and deliver $O2_2$ as in most living organisms, but that these capacities might also be utilized to concentrate $O_2$ sequentially, with a result that might be compatible with sustaining a war fighter submerged in the shallows or at high altitude in rarefied $O_2$. Referring to FIG. 8, that schematically shows my synthetic gill concept, a very large flow of seawater containing sparse $O_2$, but with $O_2$ at a partial pressure roughly equivalent to the air above (20% $O_2$, 80% N2, distribution) is pumped or swim propelled close aboard the near (left) side of a very large about 40 square meters surface area semipermeable membrane. With the water so close, dissolved $O_2$ will be drawn across the membrane, down concentration gradients, if an $O_2$ sink is created on the far (right) side of the membrane. Such a sink results from $CO_2$ permeating toward the near side, as per the physiologic Bohr Effect, as well as, to a lesser extent, by physical $CO_2$ gradients, both leaving the far side Hgb, close to the membrane, alkaline and thus avid to attach 4 molecules of $O_2$ per molecule of Hgb.

Physiologic Hemoglobin Bohr Effect $Hb\text{-}4O_2 + nH^+ \leftrightarrow 4Hb\text{-}nH^+ + 4O_2$ (Bohr effect: ← with alkalinity, → with acidity)

$CO_2 + H_2O \leftrightarrow HCO3^- + H^+$ (Bohr Effect enabling buffer reaction)

(One molecule of hemoglobin avidly attaches four molecules of $O_2$ when in a slightly alkaline environment where hydrogen ion has departed, and dumps four molecules of $O_2$ when slightly acidic as where hydrogen ion has appeared across a membrane)

Interestingly the only very similar natural Bohr related sequenced transport and concentration of $O_2$ and removal of $CO_2$ occurs in the placenta. Aided additionally by acidic products of fetus metabolism crossing the membrane in parallel with $CO_2$ and providing an additional dose of Bohr effect, as well as the greater avidity of fetal hemoglobin for $O_2$, considerable concentration of about 1½ in increased hemoglobin fetal blood results. This despite predominant $O_2$ consumption by the placenta itself as it performs its myriad active transport functions (Fetal Well-Being, Physiological Basis and Methods of Clinical Assessment, Miriam Katz, Israel Meizner and Vaclav Insler, CRC PRESS, Chapter 1, Maternal Fetal Circulation and Respiration, Section 1.2, Placental Respiratory Function, pp 5-9 (Ref. 10-11).

That still relatively large volume of relatively dilute first Hgb, in a smaller but still substantial amount of solution, would represent a first sequenced step in the concentrating of the oxygen into an ever smaller space. Packing a substance into a smaller space defines "concentration". That lesser volume of $O_2$ laden, relatively dilute, saturated Hgb in the first circuit is continuously pumped around into close proximity with the second approximately 20 square meters area membrane, where $CO_2$ coming from the far side to the near side, acidifies the just previously saturated dilute hemoglobin, causing that Hgb to dump its $O_2$ close aboard the near side of the second membrane. Still more concentrated Hgb solution flowing countercurrent on the far side of the second membrane is thus left alkaline by the loss of $CO_2$ and avid to attach four $O_2$ molecules—in an even smaller volume of a more concentrated Hgb solution.

And so on and so on past the third, about 10 square meter, membrane and on to the last, about 5 square meter membrane. Oxyhemoglobin becomes ever more concentrated and $CO_2$ continues to be expelled until in close proximity with the last membrane where highly concentrated, highly saturated Hgb faces across that membrane against the diver's countercurrent cycling breathed respiratory gas.

The diver's exhaled breath, deficient in $O_2$ and laden with $CO_2$, sets up gradients which expel $CO_2$ from and replenish $O_2$ in the diver's breathing, like in physiology.

OBJECTS OF THE INVENTION

It is accordingly a principle object of the present invention to provide a synthetic gill apparatus and method for scavenging oxygen from seawater or from thin air at higher altitudes while at the same time eliminating $CO_2$ from the blood, allowing prolonged underwater breathing without suffering from the bends or HPNS.

Another object of the present invention is to provide an artificial gill capable of dispelling $CO_2$ during liquid breathing, deep diving, and where the diver is not subject to bends because blood gases remain at normal sea level throughout.

Another object of the present invention is to combine the synthetic gill and artificial gill above into one.

Yet another object of the present invention is to provide a paracorporeal artificial lung incorporating hollow fibers of a relatively large internal diameter for conducting blood flow to achieve an optimal, non-stagnant distribution of blood during prolonged time, low flow, minimally anticoagulated, minimally or non-pumped extracorporeal circulation.

SUMMARY OF THE INVENTION

The present invention relates to a synthetic gill for scavenging oxygen from seawater and discharging carbon dioxide to the seawater such that a diver is able to remain underwater for prolonged periods of time without the need for air tanks. The synthetic gill comprises a plurality of concatenated artificial gill modules, each comprising a housing containing a plurality of tubular fibers of a semi-permeable membranous material that are arranged in a bundle. Each housing in each module has first and second inlet ports and first and second outlet ports configured so that fluid passing from the first inlet port to the first outlet port bathes the exterior walls of the tubular fibers and fluid passing from the second inlet port to the second outlet port passes through the lumens of the tubular fibers. Means are provided for coupling the second inlet port of a first endmost module to a diver's arterial blood source and the second outlet port of the first endmost module to the diver's venous return. Seawater is brought in through the first inlet port of a second endmost module and flows back out the outlet port of the second endmost module after bathing the exterior walls of the tubular fibers in the second endmost module. Further means are provided for circulating hemoglobin-rich liquid from the second outlet port of any of the plurality of modules to the first inlet port of an adjacent module and from the first outlet port of the adjacent module back to the second inlet port of a next preceding module in the concatenated string. In this way, the artificial gill is operative to scavenge and sequentially concentrate oxygen and dispel carbon dioxide.

Large inner diameter hollow fibers or nano accommodations assure low resistance to flow both through and around gas permeable hollow oxygenating fibers. Viscous whole blood, when present, is directed through relatively large lumens. Low viscosity free hemoglobin solution, or a substitute, may flow either through or around the fibers.

DESCRIPTION OF THE DRAWINGS

The foregoing features, objects and advantages of the invention will become apparent to those skilled in the art from the following detailed description of preferred embodiment, especially when considered in conjunction with the accompanying drawings in which like numerals in the several views refer to corresponding parts.

DESCRIPTION OF THE PREFERRED EMBODIMENT

Figure 1:
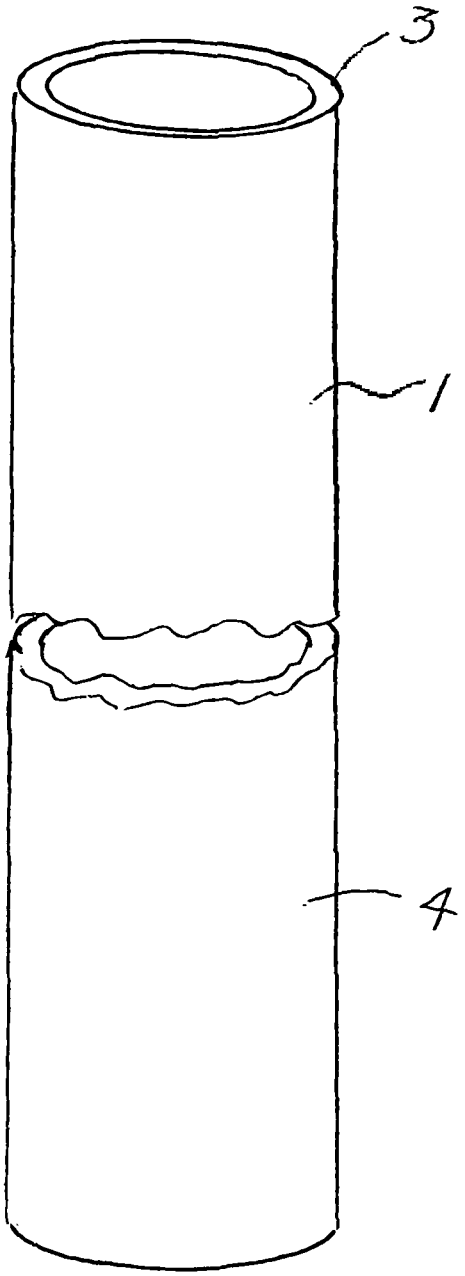
FIG. 1 is a perspective view of a large internal diameter hollow fiber.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Figure 2:
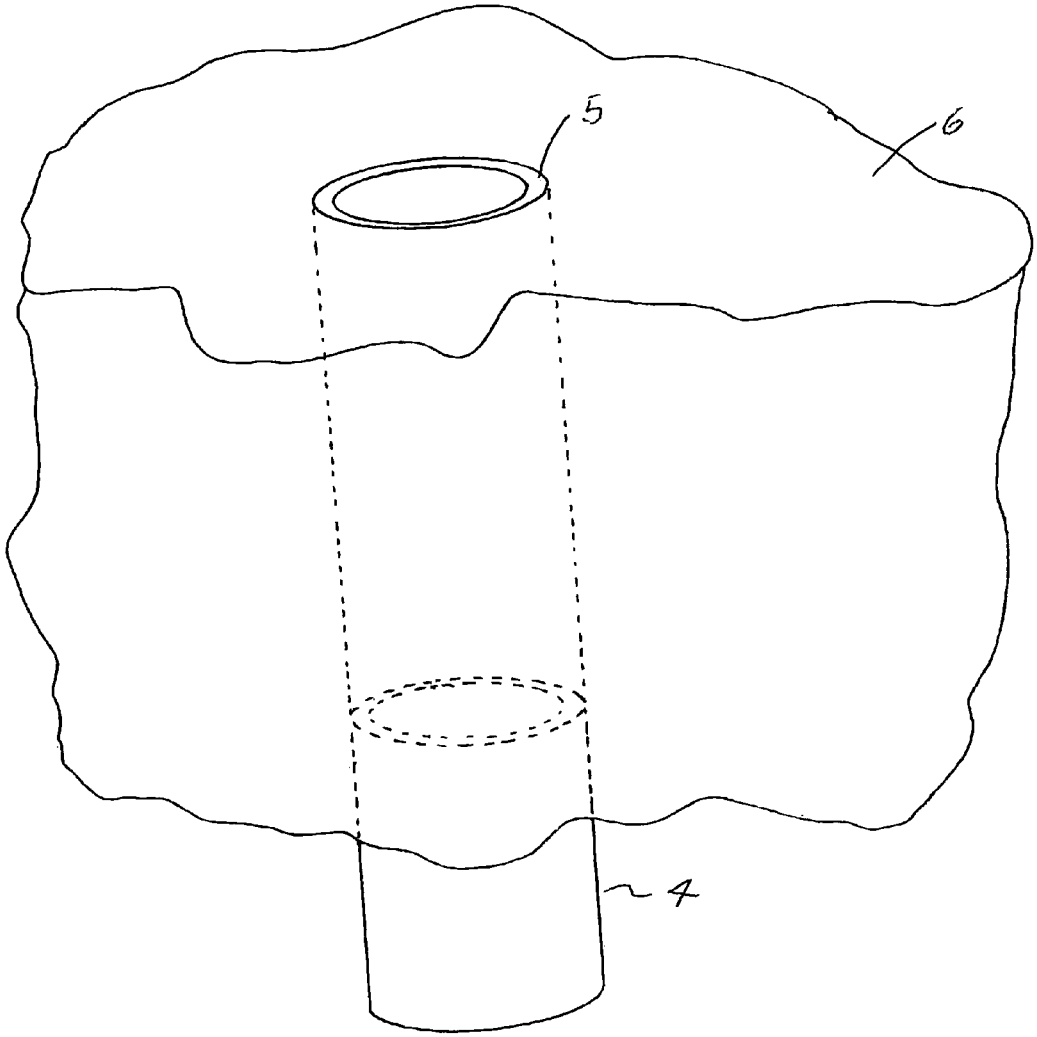
FIG. 2 is a perspective view of a potted and sliced fiber end.
Figure 3:
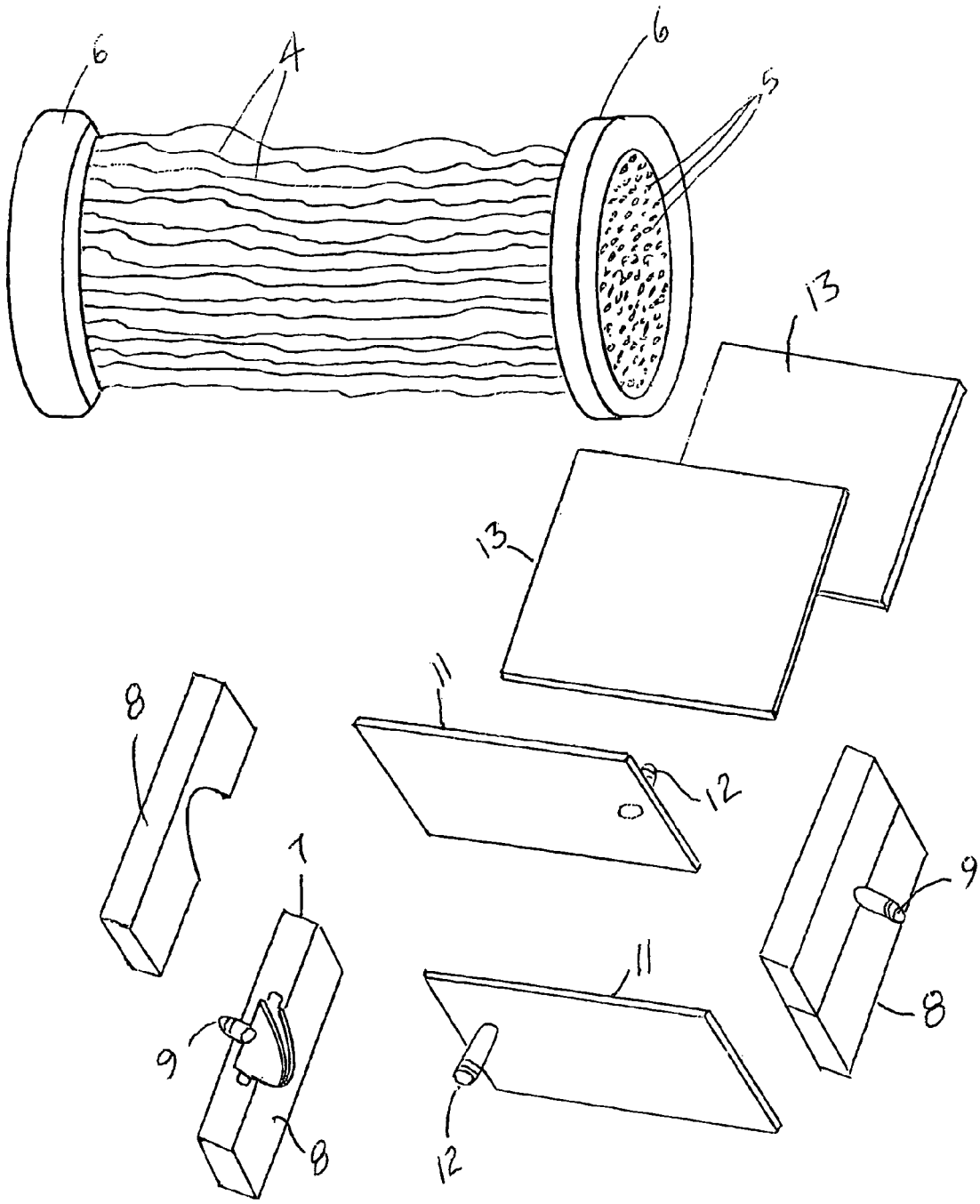
FIG. 3 is an exploded view of the insertion of plural potted fibers into modular devices.
Figure 4:
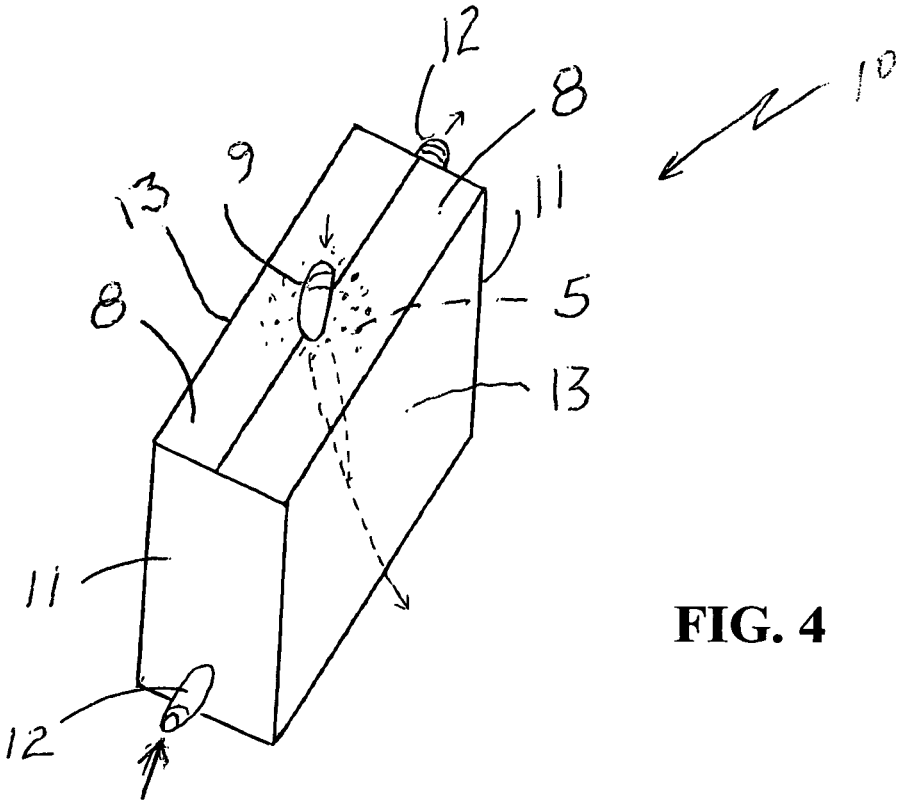
FIG. 4 is a perspective view of a, blood through fibers, deep diving, artificial gill or paracorporeal lung.

Referring to the large internal diameter, about 300 microns, hollow fiber 1, with about 50 microns thick walls, in FIG. 1, the potted 2 and sliced end 3 single fiber in FIG. 2 and the exploded view of FIG. 3, there is indicated generally by numeral 10 in FIG. 4 a preferred embodiment of the invention, namely a single module artificial gill or paracorporeal artificial lung containing 1-5 square meters of membrane. It is seen to comprise a bundle of identically formed and equally long, three inches to 3 feet, preferably silicone based, tubular fibers 4 with identically potted, in silicone or polyurethane, and sliced ends 5 and including cuffs 6 of elastic, deformable material, probably silicone or polyurethane, designed to fit and seal snugly in gutters 7 located in the two mating parts of identical blood in and outflow manifold plates 8. Blood connectors 9 are sealed between the complex manifold moldings. Identical (sea)water or $O_2$ in and outflow plates 11 with molded in connectors 12 are seen to comprise the $3^{rd}$ and $4^{th}$ sides of the box. Fifth and sixth sides are formed by identical end plates 13.

Figure 5:
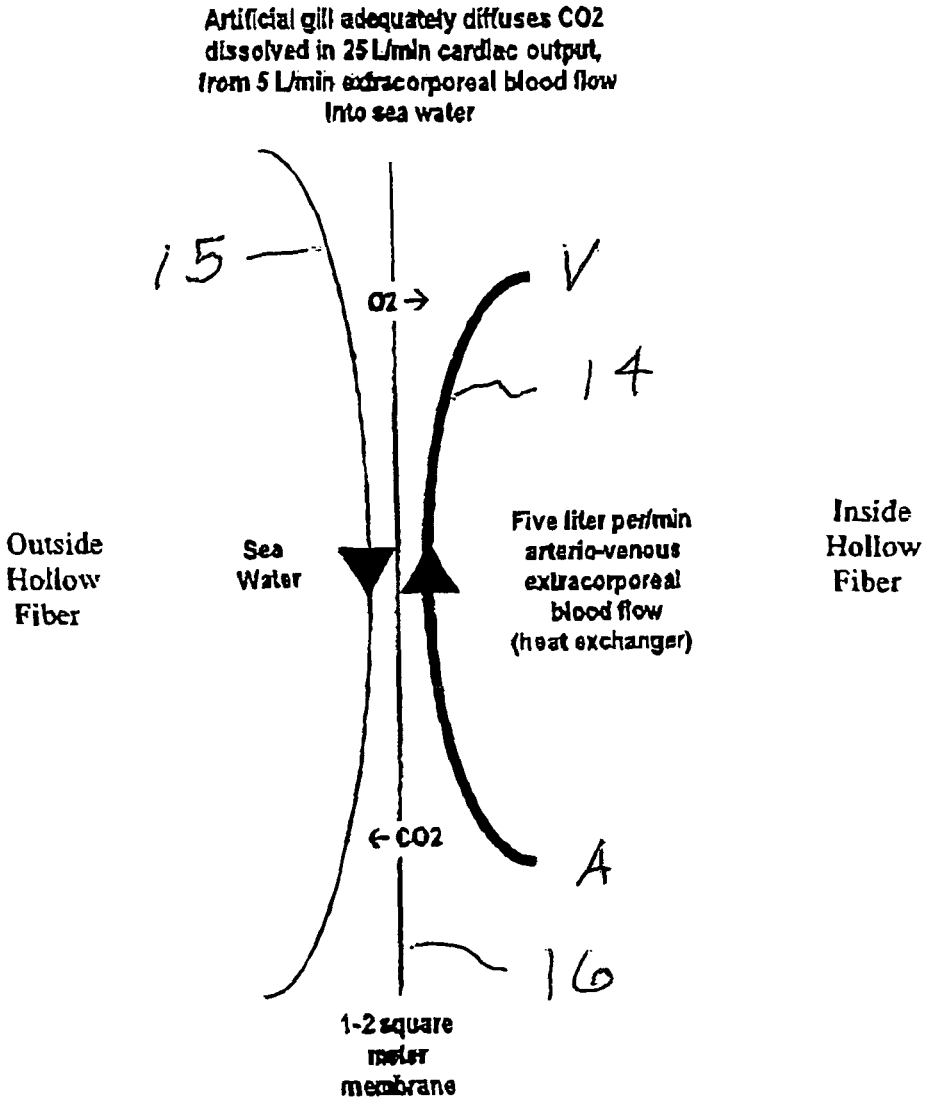
FIG. 5 is a schematic of a deep diving gill or paracorporeal lung.

A schematic of the single module artificial gill or lung, principally for $CO_2$ removal, is shown in FIG. 5 and symbolizes the diver's arteriovenous blood flow 14 passing through the lumen of a large diameter semipermeable hollow fiber roughly cross and countercurrent to the seawater or oxygen gas 15. $CO_2$ passes out of the blood and $O_2$ passes into the blood according to the Bohr hemoglobin equations. Approximately 1-5 square meters of silicone membrane 16 is thought adequate for $CO_2$ removal during deep liquid breathing diving and for oxygenation and particularly for $CO_2$ removal by an artificial assist lung.

Figure 6:
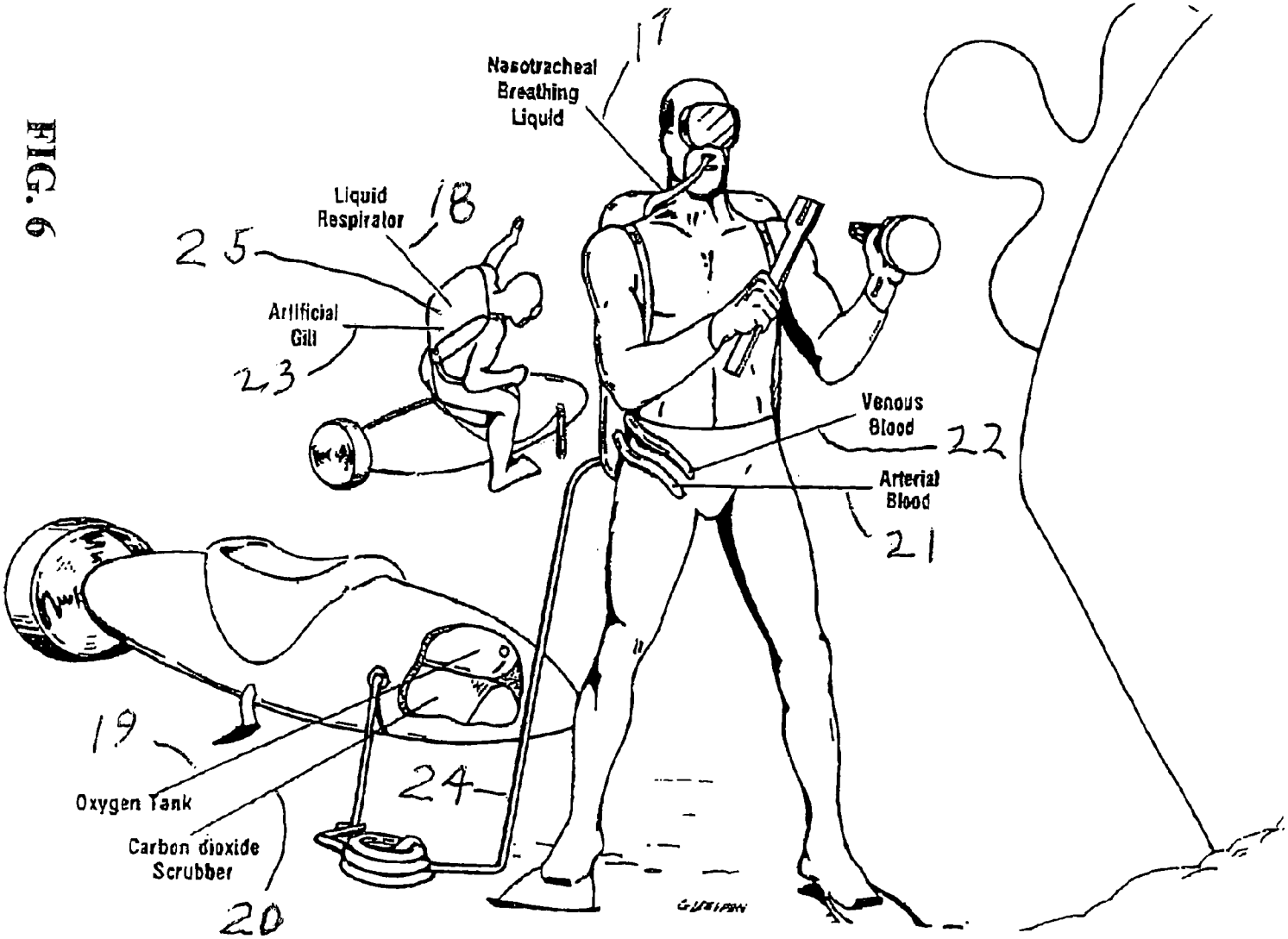
FIG. 6 is a drawing of a liquid breathing diver with an artificial gill.

The deep diver in FIG. 6 is breathing liquid from the liquid respirator 18 through a soft nasotracheal tube 17 tidally, in and out, and assistedly filling his lungs with a liquid that is bubble oxygenated from a tank 19 and decarbonated by a $CO_2$ scrubber, possibly composed of microencapsulated soda lime as in closed circuit anesthesia machines 20. Oxygenation through this route is believed to be adequate. His femoral artery 21 and vein 22 are percutaneously cannulated in order to perfuse the large diameter interiors of the fibers in his artificial gill 10. A double lumen hose 24 transfers $CO_2$ laden and deoxygenated liquid from the diver's backpack 25 to the submersible system and returns decarbonated and oxygenated inert liquid from the submersible to the diver's backpack demand triggered liquid respirator 18 and artificial gill 23.

Figure 7:
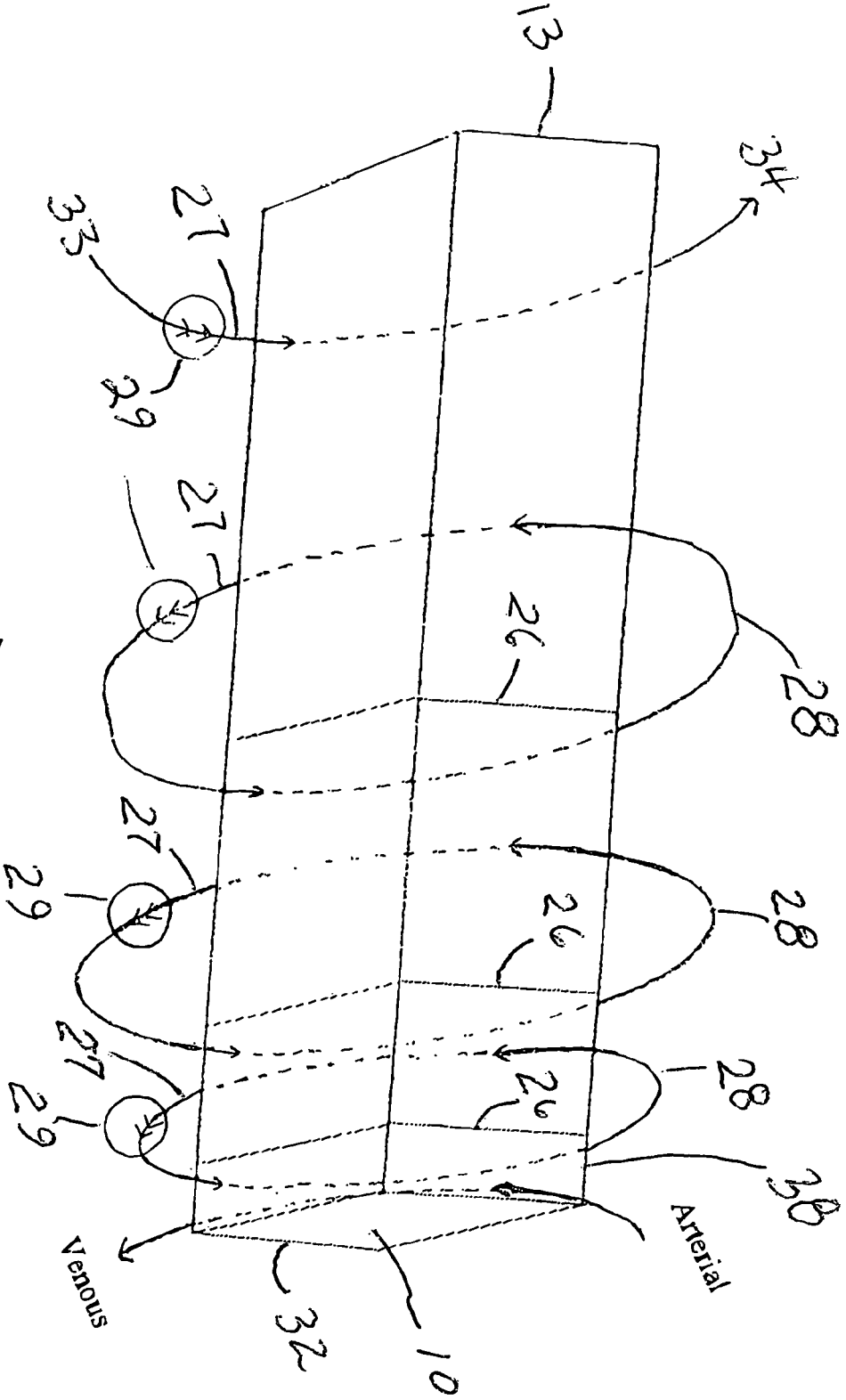
FIG. 7 is a perspective view of an oxygen scavenging synthetic gill.

There is indicated generally by numeral 30 in FIG. 7 a perspective view of a preferred embodiment of the invention, namely a multimodular, sequenced, synthetic artificial gill principally for scavenging $O_2$ and dispelling $CO_2$ from and into the seawater or thin air at altitude. It is seen, rightwardly, to comprise a final module in the oxygen concentrating sequence that is identical with the artificial gill and artificial lung 10 shown in FIG. 4. Attached modules double in size from right to left starting with 5 sqM to 10 sqM to 20 sqM to 40 sqM, leftwardly=75 sqM of membrane in the sequenced synthetic artificial gill 30 in FIG. 7. End plates 13 abut against each other physically, but the intermediate partitions 26 play no role that could not be substituted by curtains of membrane to functionally separate the sequenced modules and without occupying some space and accumulating some weight in a device where small size and light weight are at a premium. Modules are connected by external fluid flow conduits which also contain pump impellers for driving the individual Hgb solution around their individual circuits. As shown in artificial gill FIG. 4, blood enters through the connector 9 in the top manifold plate 8 and distributes evenly into the identically sliced ends 5 of the large internal diameter hollow fibers, issuing forth through the opposite ends of the fibers into the identical lower manifold plate.

Identical length fibers are packed randomly into the box between manifold plates because they will never be bathed in anything more viscous or clot or precipitate inducing than crystalloid Hgb solution. In the artificial gill or artificial lung of FIG. 4, water or air enters one side 12 and issues from the other side 12 following a cross-countercurrent flow pattern. In the modular synthetic gill of FIG. 7, Hgb solutions issuing from the bottom of the device jog, pump driven, rightwardly on to the next smaller module entering its side and proceeding around its hollow fibers and issuing forth on the other side and jogging leftwardly to reenter the top of that neighboring manifold plate. Importantly, these are seen as three separate and distinct increasingly concentrated oxyhemoglobin circuits 27,28 each perfusing two adjacent modules and each interacting with two additional Hgb circuits across semipermeable membrane barriers. Leftwardly, the first, large, module entertains water being pumped or swum around the first Hgb solution containing fibers. Rightwardly, the diver's breath or blood flows downward through the fibers and absorbs $O_2$ transmembrane from the concentrated, saturated hemoglobin and expels $CO_2$.

Figure 8:
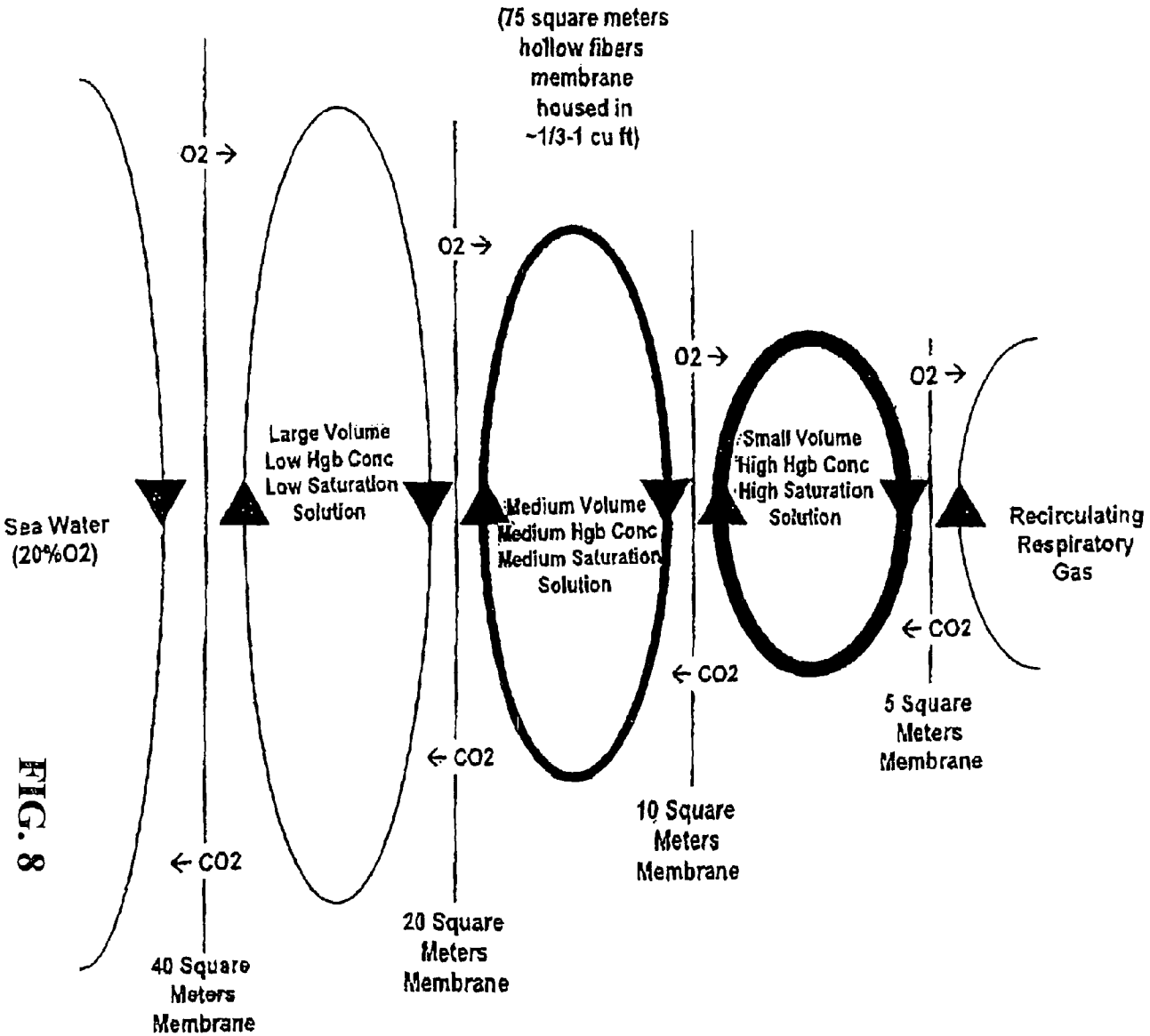
FIG. 8 is a schematic of an oxygen scavenging gill.
Figure 9:
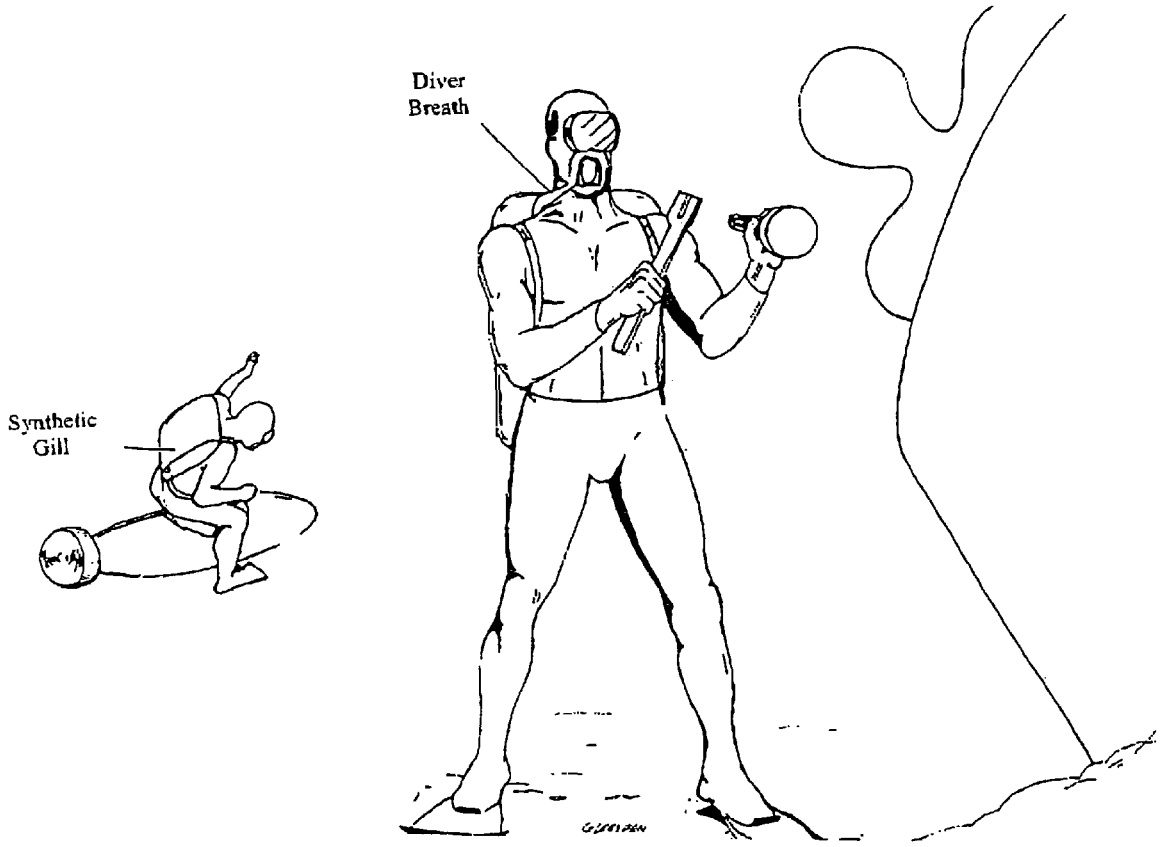
FIG. 9 is a drawing of a gas breathing diver, oxygen scavenging with a synthetic gill.

A schematic representation of the method of the preceding oxygen scavenging and concentrating synthetic gill appears in FIG. 8 where smaller volume, increasingly concentrated Hgb and increasingly $O_2$ saturated circuits are symbolized by progressively smaller ovals and thicker lines. Obviously, this is the modular extension of FIG. 5 with FIG. 5 being located rightwardly in this schematic. Membranes, indeed, represent hollow fibers. Large surface areas are expected to be required in order to obtain the duration of proximity between large flows and surfaces that is required. Still, it is useful to remember that the free Hgb is required to do no more than its stupendous physiologic stunt, which is to avidly attach 4 $O_2$ molecules when $CO_2$ moves away and leaves the microenvirons alkaline and to profusely detach and dump 4 $O_2$ molecules when $CO_2$ arrives and renders the microenvirons acid.

Figure 10:
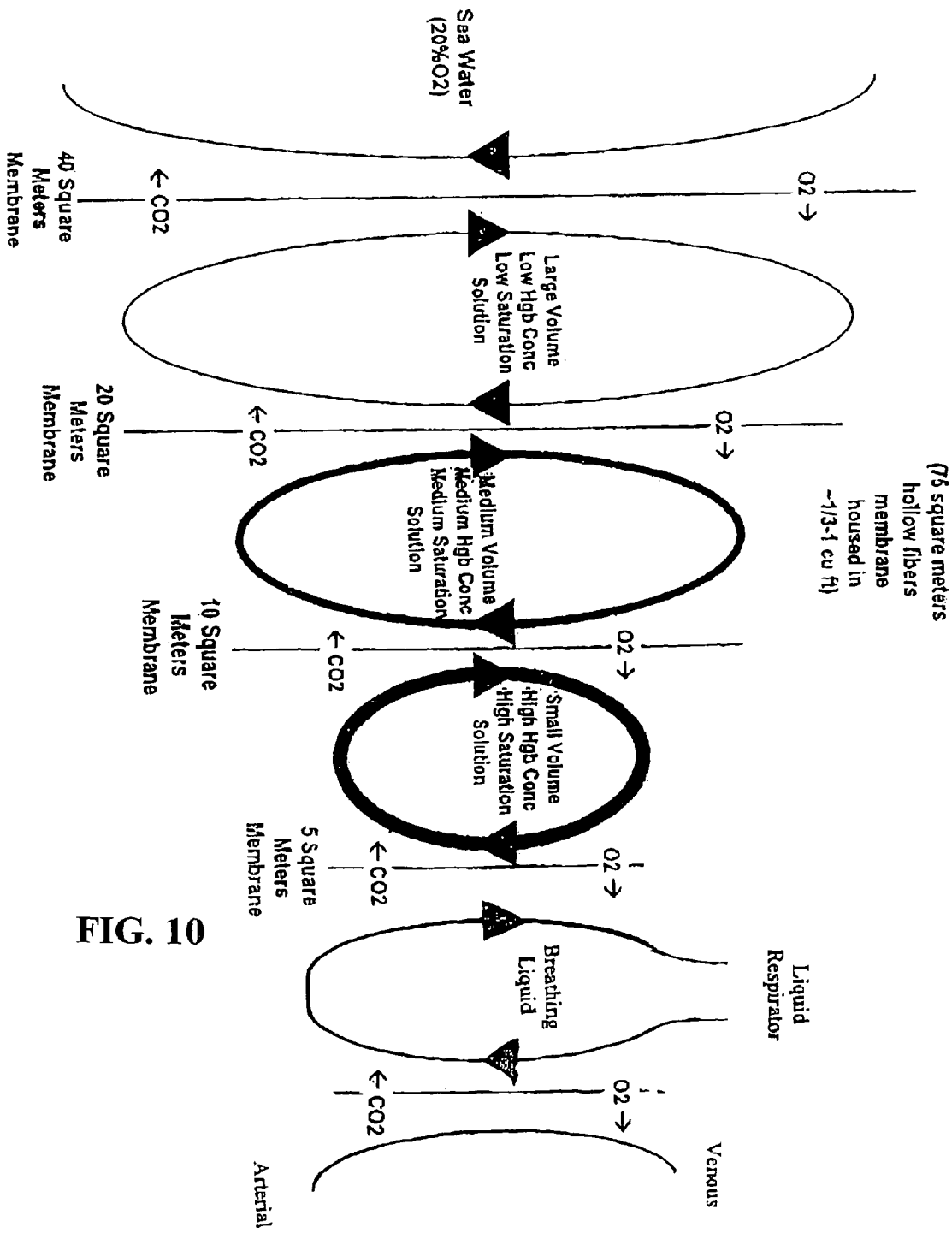
FIG. 10 is a schematic of combining deep diving (artificial) and $O_2$ scavenging and concentrating (synthetic) gills methods in one blood and liquid breathing connected device.

In the schematic of FIG. 10, the preceding concepts are taken one step further to where the deep diver of FIG. 6 is freed from his umbilical and $O_2$ tank and heat preserving closed circuit $CO_2$ scrubber. Liquid breathing continues, but the deep diver becomes nearly completely autonomous through the combination of a primarily $CO_2$ extracting artificial gill and a primarily $O_2$ scavenging and concentrating synthetic gill. The artificial gill, rightward in FIG. 10, needs to process an arteriovenous flow of only about ⅕ cardiac output to extract sufficient $CO_2$ from the diver's blood. The extracted $CO_2$ passes through the artificial gill membrane into the countercurrent flowing liquid breathing circuit after that circuit has exited the diver's liquid respirator and is passing on to the last, smallest module of the synthetic gill where, serendipitously, the $CO_2$ can traverse the membrane and amply initiate the Bohr effect exchange of $CO_2$ leftwardly out through the synthetic gill and into the seawater, and the $O_2$ rightwardly from the seawater or thin air into the breathing circuit, before it enters back into the diver's lungs.

Figure 11:
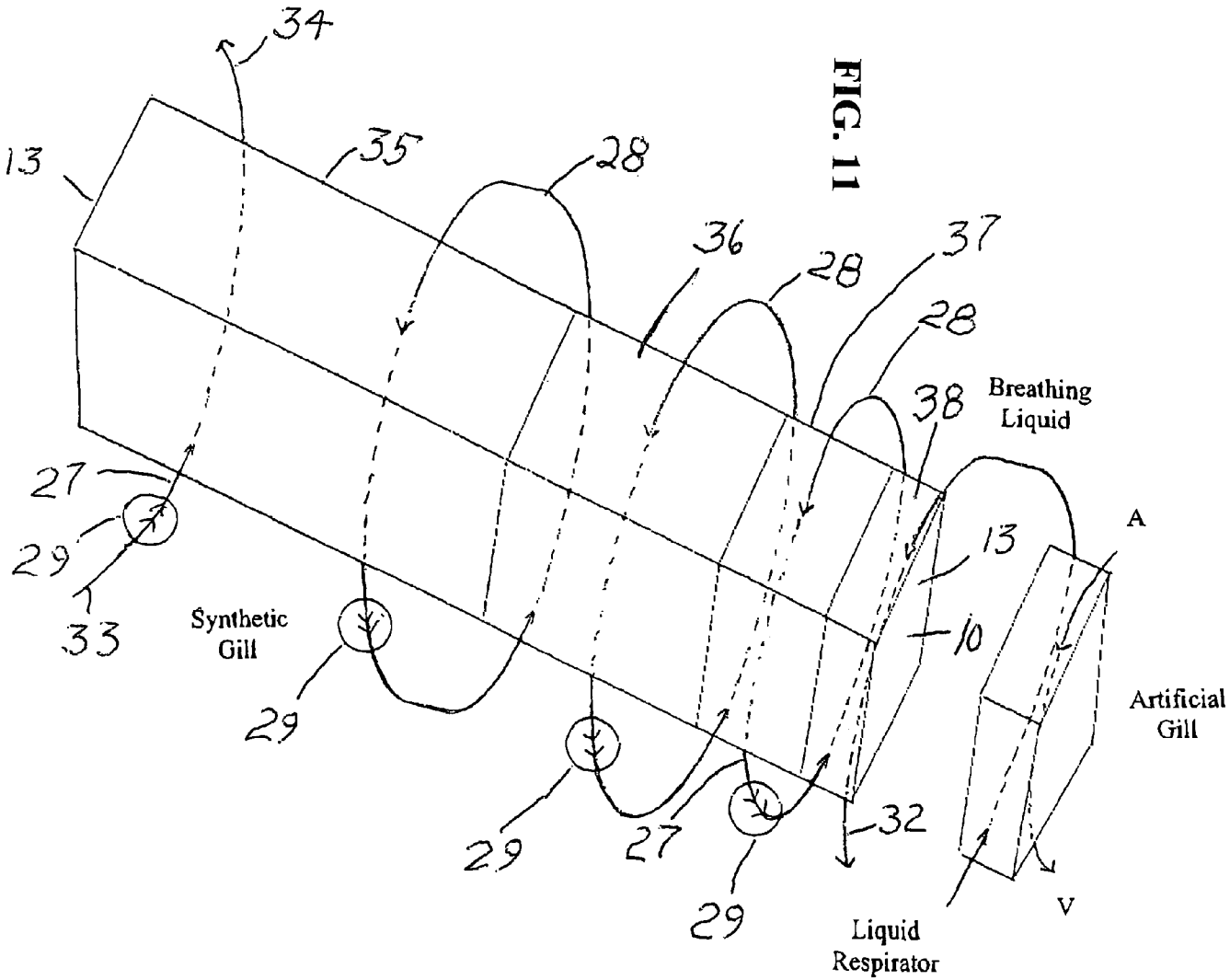
FIG. 11 is a perspective view of a deep diving (artificial) and $O_2$ scavenging and concentrating (synthetic) gill combined in one blood and liquid breathing connected device.
Figure 12:
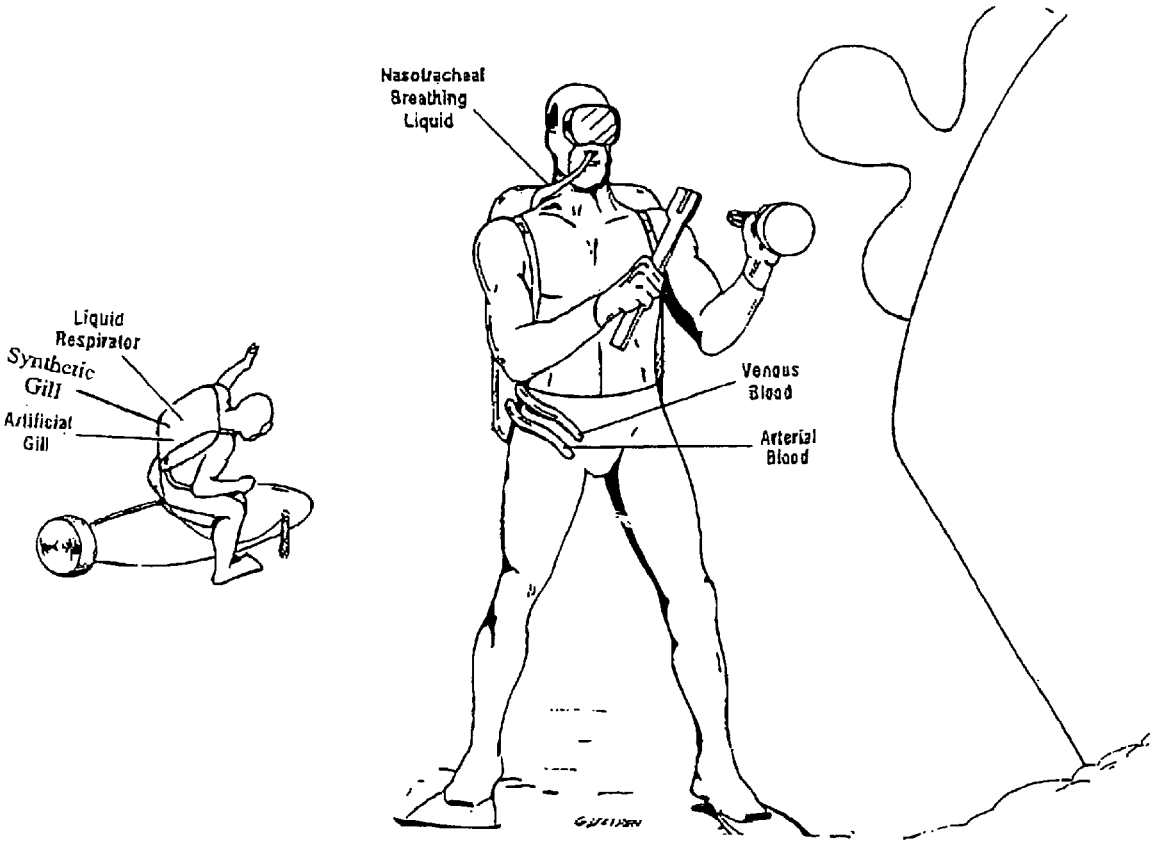
FIG. 12 is a drawing of a liquid breathing diver with combined, autonomous artificial gill and synthetic gill as in FIGS. 10 and 11.

In FIG. 11, these same arrangements are illustrated in the three-dimensional form that might occupy a diver's or climbers backpack as in FIG. 12. Nanotechnology membranes are expected to shrink these appurtenances even much further. The unencumbered diver of FIG. 12 exemplifies the extreme freedom of function in the depths that one aspires to, with only energy for the small circulating pump(s) 29 remaining as a limitation.

Operation

Deep Diving

During the several stages of a deep dive, a serendipitous complementarity exists between liquid breathing, principally for oxygenation, and the artificial gill, principally for decarbonation. While suiting up on deck, the gill might be diverting only a "to keep open" (1 Lpm) flow of blood until the lungs are filled with exceptionally capable gas carrying fluorocarbon breathing liquid. Conversion from gaseous $O_2$ breathing to liquid breathing can take place, in the upright diver, through displacement, at two or three atmospheres depth on the way down. Simultaneously, the gill blood flow is increased to up to about 5 Lpm, or whatever is required, to efficiently extract $CO_2$ from and add some oxygen to the as much as 20-25 Lpm, only marginally oxygenated and minimally $CO_2$ reduced, blood flow issuing from the liquid breathing lungs of the diver who is undergoing his initial exertions at still shallow depth. Physiologic and pharmacologic buffering can help hold the $CO_2$ line for short periods of time. In the depths, plenty of oxygenation of as much as 25 plus Lpm blood flowing through the lungs can be maintained, because whatever high concentrations of $O_2$ are required can be supplied by the highly pressurized breathing liquid. Fortunately, inefficient $CO_2$ removal by the lungs can be more than offset through whatever $CO_2$ extraction required being achieved by proportionally (⅕×1) increasing blood flow through the gill. Back near the surface, the diver turns head down and the breathing liquid is displaced with reintroduction of gaseous $O_2$. Then the need for the gill again becomes marginal. Back on deck, normal breathing of $O_2$ fortified air, perhaps still supported for a time by the gill, which might be converted to a membrane oxygenator, until recovery to normal lung function has been assured. Also serendipitous, results from both the diving and ECMO literatures suggest that either the liquid breathing or the artificial gill system, alone, would suffice to sustain life while dropping ballast or blowing a tank and being rescued from the depths. Access for both liquid breathing and artificial gill might be provided through variations of large lumen, paper-thin walled, Nitinol wire spring supported, plastic cannulae (Kolobow T, U.S. Pat. No. 5,429,127). Access for assisted liquid breathing in a working diver is best tolerated through a cuffed nasotracheal tube, well lubricated with anesthetic jelly. Inflow, in part through a small diameter, continuous flow, branched inner catheter, inserted well out into both bronchi, eliminates most dead space. Adequate access to a femoral artery(s) and vein(s) is routinely provided, and subsequently terminated with no more than local pressure over the groin, using the over the-wire, percutaneous, Seldinger technique.

Paracorporeal Artificial Lung

This artificial lung takes advantage of the low resistance to flow-through identical hollow fibers bundle of the deep diving artificial gill for conducting patient's blood in a regularized fashion that seems relatively unlikely to result in disparate flows and stasis and blood components deposition and emboli. Unlike most surgical blood oxygenators, the $O_2$ mixture is directed around the outsides of non-porous silicone rubber fibers, instead of through porous fibers, in a generally cross-current direction. The paracorporeal artificial gill of the present invention is specifically directed at low resistance blood flow through applications such as safer gravity drainage to pumped Extracorporeal Membrane Oxygenation (ECMO) and safest patient powered arterial to venous or even pumpless pulmonary artery to pulmonary vein "Artificial Lung" where central access to the pulmonary circulation is feasible.

Oxygen Scavenging Shallow Diving

The oxygen scavenging breathing device, fully charged with high frequency lysed and strained free hemoglobin. The diver straps on backpack, switches Hgb circulating pumps on and dons mask or grips mouthpiece like conventional scuba. Full operation might take a few minutes to gain speed, while exhaled $CO_2$ activates $O_2$. Diving commences. This $O_2$ scavenging diver is subject to the bends because his blood equilibrates with the gaseous mixture in his lungs. Unfortunately, 100% $O_2$ is toxic at whatever pressure, so some added inert diving gases are required and the danger of the bends remains in its usual relations with even shallow depths and times. Note, however, that a given percentage of inert diving gases near the surface becomes a much greater partial pressure with descent—thus the familiar problem of the bends. Note, also, surrounding water will have much lower partial pressures of N2 and other inerts since it is in rough equilibrium with the overlying ambient air. This differential between higher pressures of nitrogen in the diver than in the water should lead to loss of nitrogen in an open system that is exposed to the seawater and insidious, and possibly dangerous increases of the $O_2$ percentage in the lungs might eventuate. Nitrogen loss will be slowed by the multiple membranes (not especially permeable to N2 or other inert gases) that the N2 must traverse on its way out of the diver and into the seawater, or its loss might be replaced by a very small tank of compressed N2 and mini-metering replenishment into the breathing gas.

Autonomous Deep Diving With Integral Oxygen Scavenging

Diver preparing on deck suits up and has femoral catheters 21 and 22 attached and anesthetic lubricated soft nasotracheal tube 17 inserted. The backpack 25 containing liquid respirator 18 and integrated artificial and synthetic gills 23 is donned and arteriovenous blood flow through the artificial gill permitted to commence. The diver descends to some depth with synthetic gill operating in scavenging "scuba" mode, at which point air breathing is converted by flooding the lungs with appropriately super-oxygenated breathing liquid. The diver then descends to any depth, for any length of time, limited only by the life of the batteries powering the low current draw motor powering the multiple pump impellers 29 and the relative unknown of HPNS (high pressure nervous syndrome). Back close to the surface, the diver turns head down and permits lungs to drain, replacing with gaseous $O_2$, still from the $O_2$ scavenging synthetic gill feeding into the now conventional assist respirator. Back on deck, the diver is de-tubed and de-cannulated and never has been threatened by the bends.

ILLUSTRATIONS NUMBERS

1. Large internal diameter single hollow fiber
2. Potting
3. Sliced, potted end of hollow fiber
4. Fiber bundle
5. Sliced ends of bundle
6. Soft deformable cuffs
7. Gutters
8. Manifold housing
9. Blood in and outflow connectors
10. Artificial Gill or Lung
11. Seawater or $O_2$ in and outflow plates
12. Seawater or $O_2$ connectors
13. End plates
14. Arteriovenous blood flow
15. Seawater or $_{thin}$ air flow
16. Hollow fiber wall
17. Liquid breathing tubes
18. Liquid respirator
19. $O_2$ tank
20. $CO_2$ scrubber
21. Arterial blood
22. Venous blood
23. Artificial gill
24. Double lumen hose
25. Back pack
26. Inside end plates—curtains
27. Hgb outflow conduits

28. Hgb inflow conduits
29. Pumps
30. Sequenced synthetic artificial gill
31. Breath inlet
32. Breath outlet
33. Water or thin air in
34. Water or thin air out
35. 40 M2 artificial gill
36. 20 M2 artificial gill
37. 10 M2 artificial gill
38. 5 M2 artificial gill
39. Arterial canula
40. Venous canula
41. Liquid breathing into diver
42. Liquid breathing out of diver This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. An artificial gill for deriving and concentrating $O_2$ from seawater and discharging $CO_2$ to the seawater comprising:

(a) a plurality of serially joined modules, each comprising a housing containing a plurality of tubular fibers of a semi-permeable membranous material arranged as a bundle to create an effective $O_2$ and $CO_2$ exchange contact area, each housing of each module having first and second inlet ports and first and second outlet ports configured so that fluid passing from the first inlet port to the first outlet port bathes exterior walls of the tubular fibers and fluid passing from the second inlet port to the second outlet port passes through lumens of the tubular fibers;

(b) means for coupling the second inlet port of a first endmost module to a diver's blood source and the second outlet port of the first endmost module to the diver's blood return;

(c) means for flowing seawater only through the second endmost module of the plurality of serially joined modules from the first inlet port of the second endmost module to the first outlet port of the second endmost module; and (d) means including a pump for each of said modules for circulating hemoglobin rich liquids from the second outlet port of any of the plurality of modules to the first inlet port of an adjacent module and from the first outlet port of said adjacent module back to the second inlet port of a next preceding module and where the exchange contact area and contained volume of each of the adjacent serially joined modules decreases in progressing from the second endmost module to the first endmost module whereby the concentration of $O_2$ increases in progressing from the second endmost module to the first endmost module.

2. The artificial gill as in claim 1 wherein the exchange contact area and contained volume of the plurality of tubular fibers in each of the plurality of serially joined modules decreases by about fifty percent from module to module in progressing from the second endmost module to the first endmost module.

* * * * *